US012460506B2

(12) United States Patent
Perschke

(10) Patent No.: US 12,460,506 B2
(45) Date of Patent: Nov. 4, 2025

(54) VALVES FOR WELL SYSTEMS AND METHODS OF OPERATING SAME

(71) Applicant: Heshka Oil, Conroe, TX (US)

(72) Inventor: Malcolm Perschke, Conroe, TX (US)

(73) Assignee: TEXAS HIGHLAND HOLDINGS LLC, Conroe, TX (US)

( * ) Notice: Subject to any disclaimer, the term of this patent is extended or adjusted under 35 U.S.C. 154(b) by 0 days.

(21) Appl. No.: 18/457,226

(22) Filed: Aug. 28, 2023

(65) Prior Publication Data

US 2025/0075590 A1 Mar. 6, 2025

(51) Int. Cl.
*E21B 34/02* (2006.01)

(52) U.S. Cl.
CPC ..... *E21B 34/02* (2013.01); *E21B 2200/01* (2020.05)

(58) Field of Classification Search
CPC ..... E21B 34/02; E21B 2200/01
USPC ..... 166/97.1
See application file for complete search history.

(56) References Cited

U.S. PATENT DOCUMENTS

| | | | |
|---|---|---|---|
| 334,690 | A | 1/1886 | Craik |
| 3,586,106 | A | 6/1971 | Conrad |
| 3,624,979 | A | 12/1971 | Przybylski |
| 3,766,941 | A | 10/1973 | Davis, Jr. |
| 3,912,008 | A | 10/1975 | Crowe |
| 4,287,912 | A | 9/1981 | Hewett |
| 5,875,851 | A | 3/1999 | Vick, Jr. et al. |
| 6,199,628 | B1 | 3/2001 | Beck et al. |
| 6,719,059 | B2 | 4/2004 | Dezen et al. |
| 7,051,810 | B2 | 5/2006 | Clemens et al. |
| 7,121,344 | B2 | 10/2006 | Fenton et al. |
| 7,195,225 | B1 | 3/2007 | Holliday |
| 8,028,752 | B2 | 10/2011 | Richards |
| 8,555,986 | B2 | 10/2013 | Clemens et al. |
| 9,382,777 | B2 | 7/2016 | Pettersen et al. |
| 10,082,005 | B2 | 9/2018 | Salomonsen et al. |
| 10,087,693 | B2 | 10/2018 | Bye |

(Continued)

FOREIGN PATENT DOCUMENTS

WO WO 2006/061645 6/2006

OTHER PUBLICATIONS https://www.heshkaoil.com/products/type-h-back-pressure-valves/, website pages, 4 pages, printed out on Aug. 15, 2023 (origination date unknown).

(Continued)

*Primary Examiner* — Tara Schimpf
*Assistant Examiner* — Patrick F Lambe
(74) *Attorney, Agent, or Firm* — NIXON & VANDERHYE P.C.

(57) ABSTRACT

A valve for use in a hanger body of a well system comprises a valve body. The valve body comprises an exterior surface comprising three segments. A first segment of the exterior surface is configured with a helical thread to engage a counter-threaded portion of the tubing hanger body. A second segment of the exterior surface is configured as an essentially circumferential groove to accommodate an essentially toroidal sealing member. The groove comprises essentially right angle shoulders at both intersections of the groove with the exterior surface. A third segment of the exterior surface is configured to be devoid of the helical thread, the third segment being intermediate the first segment and the second segment.

22 Claims, 10 Drawing Sheets

(56) References Cited

U.S. PATENT DOCUMENTS

| | | | | |
|---|---|---|---|---|
| 11,530,592 | B2 | 12/2022 | Perschke | |
| 2009/0194291 | A1 | 8/2009 | Fesi et al. | |
| 2010/0200217 | A1 | 8/2010 | Gette | |
| 2012/0024521 | A1 | 2/2012 | Villa | |
| 2014/0116720 | A1* | 5/2014 | He | E21B 21/10 166/373 |
| 2016/0258232 | A1 | 9/2016 | Harper | |
| 2018/0080291 | A1 | 3/2018 | Sipos | |
| 2019/0178412 | A1* | 6/2019 | Leon | F16K 37/0008 |
| 2020/0040687 | A1 | 2/2020 | Kleppa | |
| 2020/0248523 | A1* | 8/2020 | Craycraft | E21B 33/04 |

OTHER PUBLICATIONS

U.S. Appl. No. 18/533,864 filed Dec. 2023, Perschke.
U.S. Office Action dated Jan. 27, 2025 issued in U.S. Appl. No. 18/533,864, 17 pp.

* cited by examiner

PRIOR ART

VALVES FOR WELL SYSTEMS AND METHODS OF OPERATING SAME

TECHNICAL FIELD

The technology relates to valves that may be employed in a well system, particularly valves that employ sealing elements which provide a seal between the valve and a tubing hanger, for example.

BACKGROUND

There is a need in the oilfield to be able to remove equipment such as a valve or a series of valves, collectively and/or more commonly known as a Wellhead Christmas Tree, from a wellhead for servicing purposes. A component known as a Back Pressure Valve (BPV) may be employed for such equipment removal while still maintaining pressure control of the production tubing. An example of a Back Pressure Valve (BPV) is shown in FIG. 1. See also https://www.heshkaoil.com/products/type-h-back-pressure-valves/.

Another reason for using a Back Pressure Valve may be to facilitate installation of a Blow-Out Preventer to the wellhead in preparation of working over a well. A feature of the Back Pressure Valve is that the Back Pressure Valve has flow through capability in the event that there is a need to kill the well. The design of the Back Pressure Valve with a spring-energized poppet enables the well kill.

There is a step in the process during the removal of the old Wellhead Christmas Tree and replacement with a new one that requires a different component to be utilized. When new/different equipment has been installed onto the wellhead there is a need to confirm the integrity of the new connection to hold pressure. To confirm the integrity of the new connection it is common in the industry to utilize what is known as a Two-Way Check Valve (TWCV). An example prior art Two-Way Check Valve (TWCV) is shown in FIG. 2. The disadvantage of running and installing a type of unit such as a Two-Way Check Valve relies on the operator's skill and feel as to when there is sufficient torque applied to the sealing element of the Two-Way Check Valve to provide a seal. Most especially this is critical in the running and setting of the two-way check valve.

The structure of the example prior art Back Pressure Valve (BPV) 120 shown in FIG. 1 and the structure of the example prior art Two-Way Check Valve 220 shown in FIG. 2 provide context for discussion of disadvantages of such prior art valves utilized in wellheads. In the landscape views of both FIG. 1 and FIG. 2, the top of the respective valves 120 and 220 is at left of the figures. Both the example prior art Back Pressure Valve (BPV) 120 and the example prior art Two-Way Check Valve 220 are briefly described below in simplified manner.

The example prior art Back Pressure Valve (BPV) 120 of FIG. 1 comprises a valve body 122. In a region of its greatest diameter the valve body 122 comprises external circumferential threads 124 which are configured to mate with a counter-threaded interior surface of a tubing hanger. A cavity 126 is defined in the interior of valve body 122. A spring-energized poppet 128 is situated in cavity 126. As shown in FIG. 4, valve body 122 may also comprise a channel 129 on its inner diameter. The channel 129 may comprise a machined slot in the BPV 120 that ensures a barrier free passage for fluid when it is being retrieved using the retrieval tool. For example, the channel 129 may be configured to facilitate pressure relief when the poppet 128 is displaced from its seat. FIG. 4 further shows a tapered surface leading to a through bore in which poppet 128 sits.

A seal 130 is provided in the region of the greatest diameter of valve body 122 but vertically above the external circumferential threads 124 when employed in a wellhead. The seal 130 is accommodated in a seal seating groove 132 which extends around a circumference of the valve body 122. The seal 130 is intended to form a seal between the valve body 122 of Back Pressure Valve (BPV) 120 and the tubing hanger into which the Back Pressure Valve (BPV) 120 is threadingly engaged.

The example prior art Two-Way Check Valve 220 of FIG. 2 similarly comprises a valve body 222 comprising external circumferential threads 224 and having cavity 226 defined in an interior of valve body 222, with poppet 228 being situated in cavity 226. A seal 230 is provided in the region of the greatest diameter of valve body 222 but upstream of the external circumferential threads 224. The seal 230 is accommodated in a seal seating groove 232 which extends around a circumference of the valve body 222. The seal 230 is intended to form a seal between the valve body 222 of Two-Way Check Valve 220 and the tubing hanger into which the Two-Way Check Valve 220 is threadingly engaged.

A problem with both the prior art Back Pressure Valve (BPV) and the prior art Two-Way Check Valve is that the external threads are designed and configured to break into the seal carrier grooves. The seal seating groove 132 is shown in FIG. 3 as comprising groove top pressure surface 134 and groove bottom pressure surface 136. As described with respect to FIG. 3, the "top" and "bottom" refer to vertical orientation of the valve in the wellhead, whereas with respect to FIG. 1 "top" and "bottom" without reference to any particular valve structure refer to orientation or location in the landscape figure. The interference or intrusion of the external thread 124 of Back Pressure Valve (BPV) 120 into the seal carrier groove 132 is illustrated in FIG. 1 and FIG. 3, for example, by a trough of the external circumferential thread 124 occurring in a region 138 of the groove bottom pressure surface 136, as shown in FIG. 3 and at the bottom of FIG. 1, in contrast to a crest of the external circumferential thread 124 occurring a right edge of the seal seating groove 132 as shown at the top of FIG. 1. As shown in more detail in FIG. 3, the trough of the external circumferential thread 124 occurring in the region 138 of the groove bottom pressure surface 136 of the seal seating groove 132 eats into or defrays the shoulder of the groove bottom pressure surface 136 of the seal seating groove 132. As a result of the right shoulder of seal seating groove 132 not extending to its potential full radial extent, upon application of pressure to the valve, e.g., by torquing the valve, the seal 130 is prone to deform and to spread or bulge axially, rather than to fully form the radial sealing engagement with the surrounding tubing hanger. Moreover, by not fully forming a seal at the groove bottom pressure surface 136, the seal 130 has a tendency to extrude and fail by reason, e.g., of greater pressure being applied to the top of the seal (BPV), at the portion of seal 130 near the groove top pressure surface 134. Essentially the same problematic situation occurs in the Two-Way Check Valve 220 of FIG. 2, for example, in which a trough of the external circumferential thread 224 occurs at the right edge of the seal seating groove 232 as shown at the top of FIG. 2. It is at the right edge at which the thread ends in the groove.

The deformation of sealing material into an adjacent threaded region in wellhead valves such as a Back Pressure Valve (BPV) and a Two-Way Check Valve reduces the area of lower pressure surface supporting the seal and prevents the seal from fully radially extruding, which may lead to failure of the seal. The lower or reduced lower pressure surface area is where the seal can extrude into trough 138 as there is nothing to prevent it doing so.

Another disadvantage of the prior art is that, if excessive torque is applied through the valves, the thread can start to cut into the seal rendering it useless. Since torque application is largely a matter of operator feel/sensitivity, application of excessive torque is not uncommon.

The technology disclosed herein seeks to mitigate or eliminate various disadvantages involved in the construction and use of prior art valves that employ seals, such as Back Pressure Valves and Two-Way Check Valves.

SUMMARY

In one of its example embodiments and modes, the technology disclosed herein concerns a valve for use in a hanger body of a well system comprises a valve body. The valve body comprises an exterior surface comprising three segments. A first segment of the exterior surface is configured with a helical thread to engage a counter-threaded portion of the tubing hanger body. A second segment of the exterior surface is configured as an essentially circumferential groove to accommodate an essentially toroidal sealing member. The groove comprises essentially right angle shoulders at both intersections of the groove with the exterior surface. A third segment of the exterior surface is configured to be devoid of the helical thread, the third segment being intermediate the first segment and the second segment.

In another of its example aspects the technology disclosed herein concerns a valve for use in a hanger body of a well system. The valve comprises a valve body comprising an exterior surface comprising at least two segments. A first segment of the exterior surface is configured with a helical thread to engage a counter-threaded portion of the tubing hanger body. A second segment of the exterior surface is configured as a groove to accommodate an essentially toroidal sealing member. The valve is configured for insertion into the hanger body in an axial direction. In a radial plane which is perpendicular to the axial direction the groove extends about 0.118 inch.

In yet another of its example aspects the technology disclosed herein concerns a valve for use in a hanger body of a well system. The valve is configured for insertion into the hanger body in an axial direction. In an example embodiment and mode the valve comprises a valve body comprising an exterior surface. A first segment of the exterior surface is configured with a helical thread to engage a counter-threaded portion of the tubing hanger body. A second segment of the exterior surface is configured as an essentially circumferential groove to accommodate an essentially toroidal sealing member. A third segment of the exterior surface configured to be essentially smooth and parallel to the axial direction. The third segment is intermediate the first segment and the second segment, and in the axial direction the third segment of the exterior surface extends for about 0.10 inches.

In still another of its example aspects the technology disclosed herein concerns a method of inserting a valve into a hanger body of a well system. In a basic example embodiment and mode, the method comprises axially inserting a valve into a hanger body of a well system and then rotating the valve to cause axial travel of the valve within the hanger body by engagement of the helical thread with a counter-threaded portion of the tubing hanger body until further axial travel is stopped by a helically threadless segment of an exterior surface of the valve body.

BRIEF DESCRIPTION OF THE DRAWINGS

The foregoing and other objects, features, and advantages of the technology disclosed herein will be apparent from the following more particular description of preferred embodiments as illustrated in the accompanying drawings in which reference characters refer to the same parts throughout the various views. The drawings are not necessarily to scale, emphasis instead being placed upon illustrating the principles of the technology disclosed herein.

DETAILED DESCRIPTION

Figure 1:
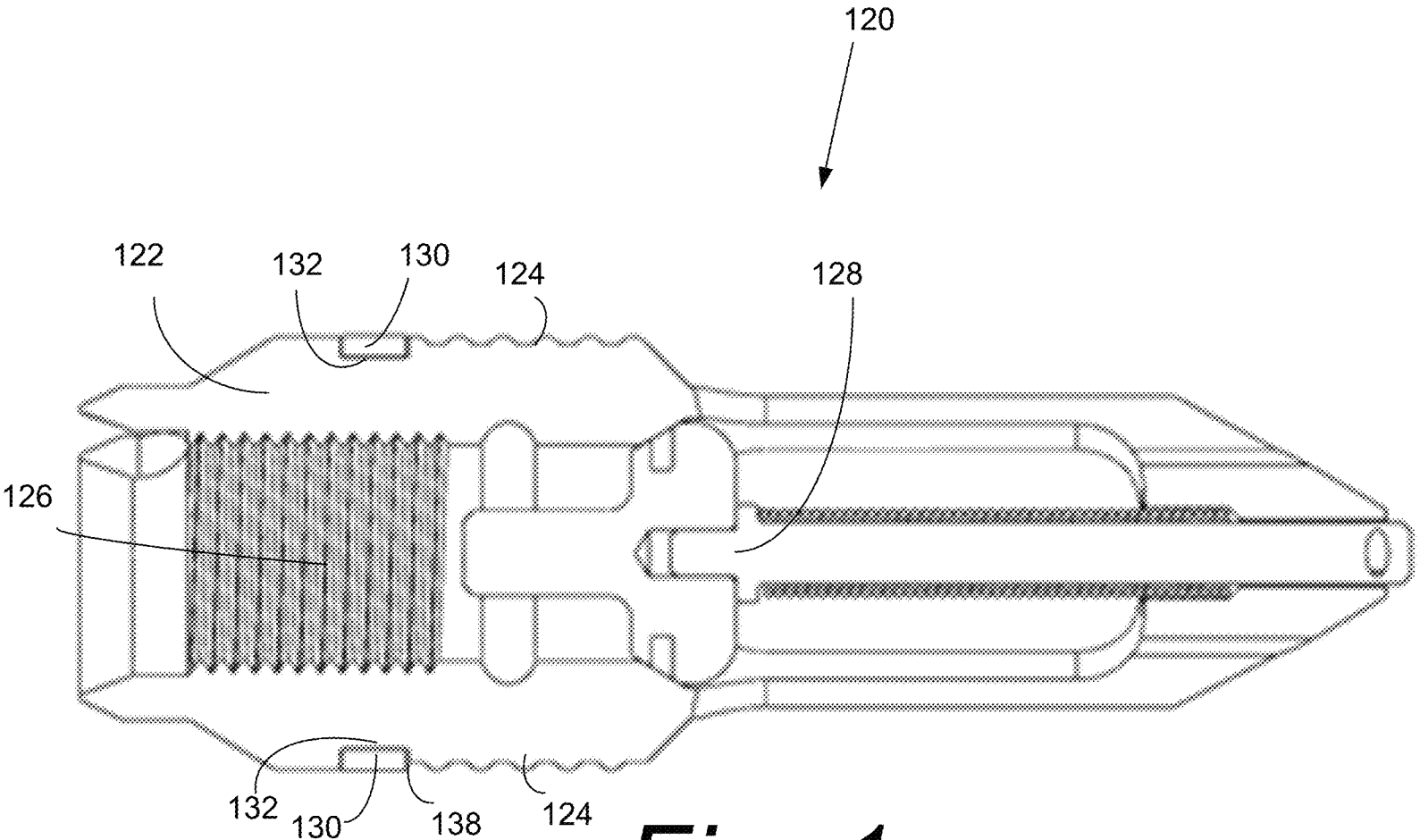
FIG. 1 is a cross sectional view of a prior art Back Pressure Valve (BPV) for plugging off a well.

In the following description, for purposes of explanation and not limitation, specific details are set forth such as particular architectures, interfaces, techniques, etc. in order to provide a thorough understanding of the technology disclosed herein. However, it will be apparent to those skilled in the art that the technology disclosed herein may be practiced in other embodiments that depart from these specific details. That is, those skilled in the art will be able to devise various arrangements which, although not explicitly described or shown herein, embody the principles of the technology disclosed herein and are included within its spirit and scope. In some instances, detailed descriptions of well-known devices, circuits, and methods are omitted so as not to obscure the description of the technology disclosed herein with unnecessary detail. All statements herein reciting principles, aspects, and embodiments of the technology disclosed herein, as well as specific examples thereof, are intended to encompass both structural and functional equivalents thereof. Additionally, it is intended that such equivalents include both currently known equivalents as well as equivalents developed in the future, i.e., any elements developed that perform the same function, regardless of structure.

Thus, for example, it will be appreciated by those skilled in the art that block diagrams herein can represent conceptual views of illustrative circuitry or other functional units embodying the principles of the technology. Similarly, it will be appreciated that any flow charts, state transition diagrams, pseudo code, and the like represent various processes which may be substantially represented in computer readable medium and so executed by a computer or processor, whether or not such computer or processor is explicitly shown.

The technology disclosed herein generally relates to valves for use in a well system. As used herein, "well system" encompasses any application where it is required to isolate the upper portions of a system from pressure generated below the system. Thus "well system" encompasses various applications and installations, such as wellheads, water loop applications, and geothermal applications, for example. Unless otherwise clear from the context, reference herein to "wellhead" may encompass well system. In some of its example aspects the technology disclosed herein may relate to back pressure valves and two-way check valves for well systems, for example, that may be employed for sealing off a well such as those in the oil and gas field to provide well control during secondary maintenance of equipment, such as Wellhead Trees or Blowout Preventers, for example. Further, in one of its example aspects the technology disclosed herein relates to providing a feature that ensures a positive indication that valves for use in a well system, such as back pressure valves and/or two-way check valve, are landed in a correct position within the tubing hanger during the installation process.

Figure 5:
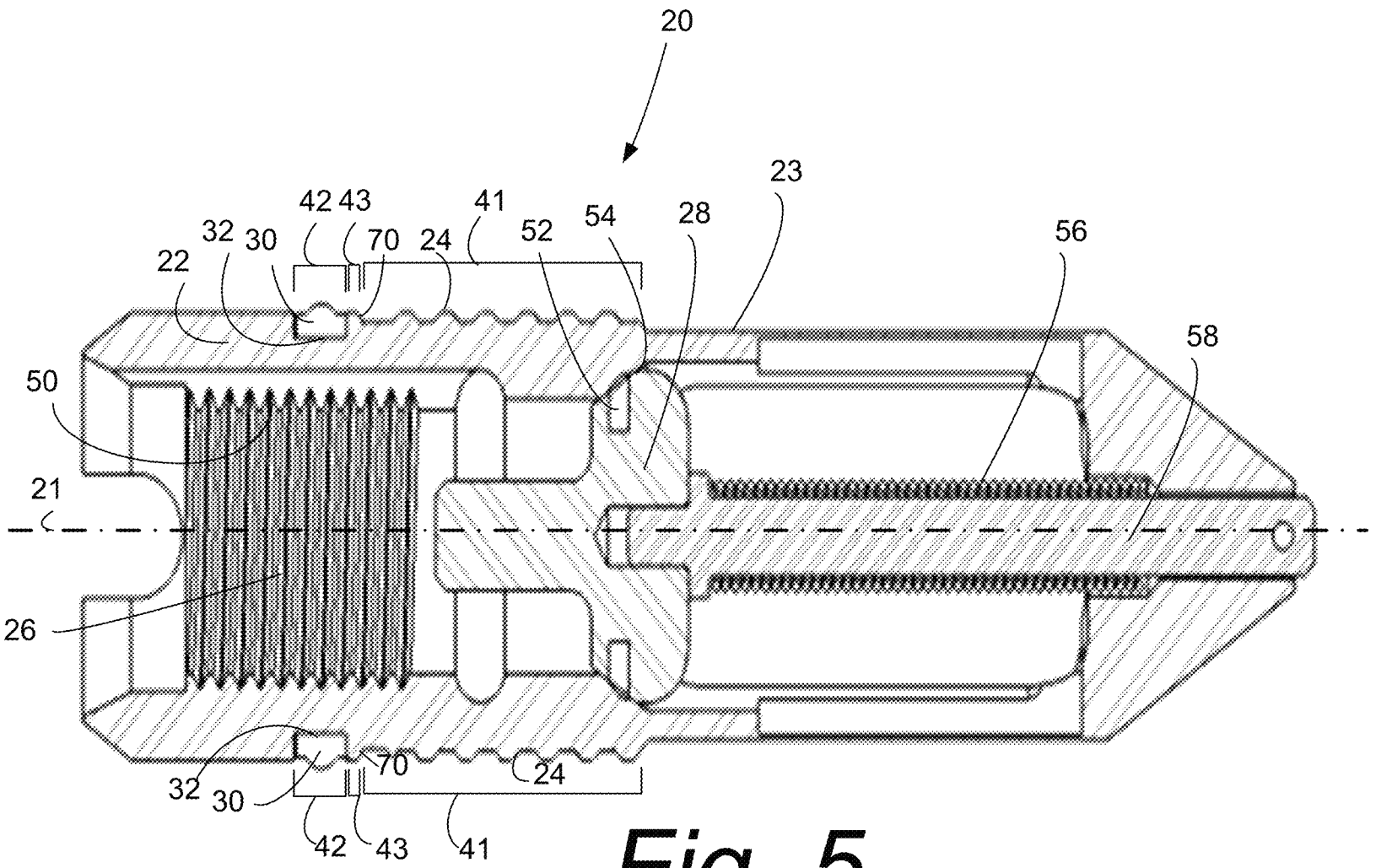
FIG. 5 is a cross sectional of an example Back Pressure Valve according to an example embodiment and mode.

FIG. 5 shows, in cross section, a valve 20 for use in a hanger body of a wellhead. The particular valve shown in FIG. 5 is a Back Pressure Valve (BPV), but it should be understood that sealing structure as described herein for valve 20 may also be employed in a Two-Way Check Valve. In an example embodiment and mode, valve 20 comprises valve body 22 that extends along valve body axis 21. The valve 20 is configured for insertion into a hanger body in the direction of body axis 21, e.g., in the axial direction. The valve body 22 is shown as comprising valve body exterior surface 23 and interior cavity 26. The interior cavity 26 is configured to accommodate a poppet 28.

The valve body exterior surface 23 is shown in FIG. 5 as comprising at least plural exterior surface segments, including exterior surface first segment 41, exterior surface second segment 42, and exterior surface third segment 43. The valve body exterior surface 23 extends beyond the segments 41, 42, and 43, in both upstream and downstream directions, e.g., to the left and right of segments 41, 42, and 43 in FIG. 5.

Figure 6A:
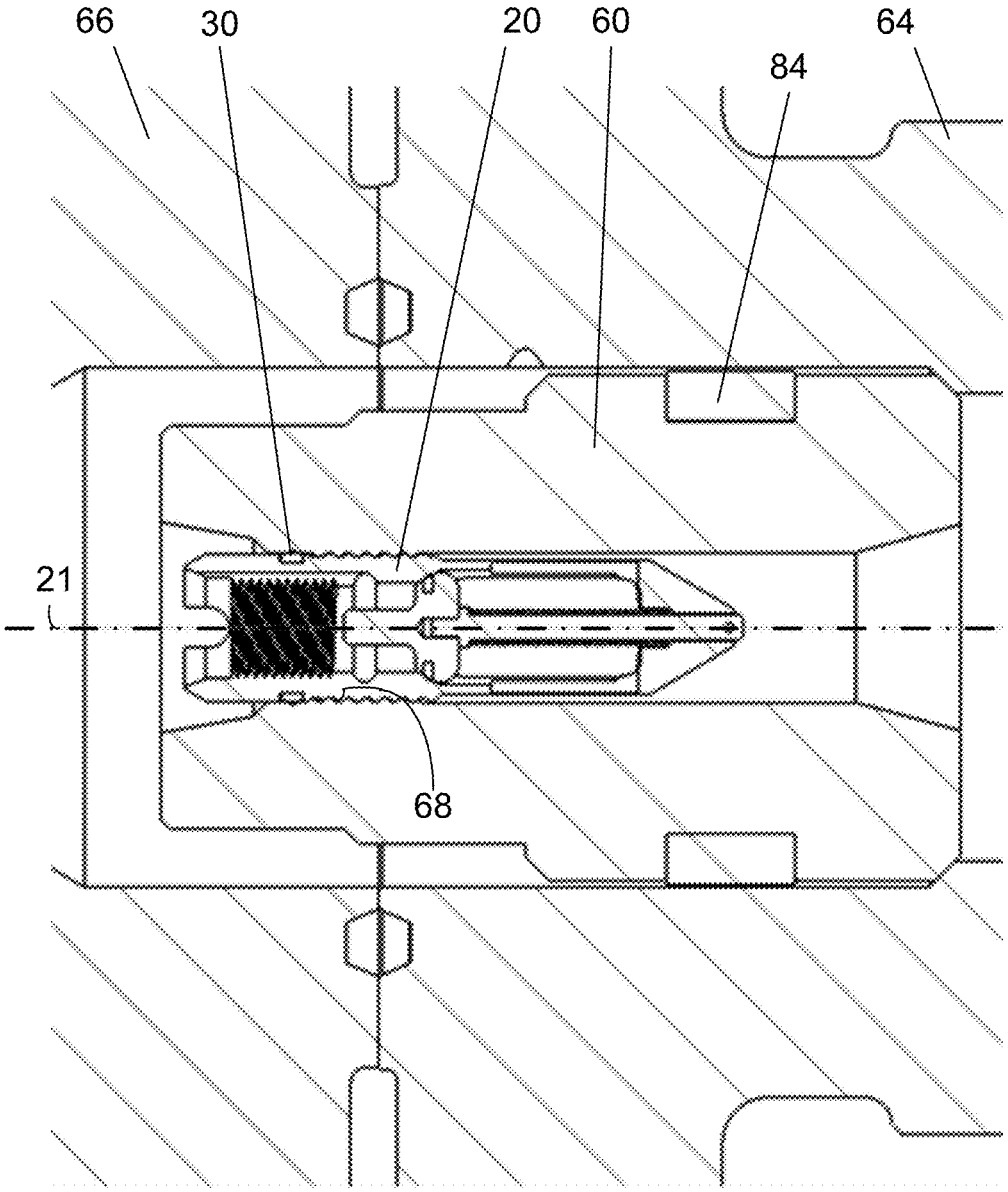
FIG. 6A is a cross sectional view showing the Back Pressure Valve of FIG. 4 installed in a wellhead tubing hanger.
Figure 6B:
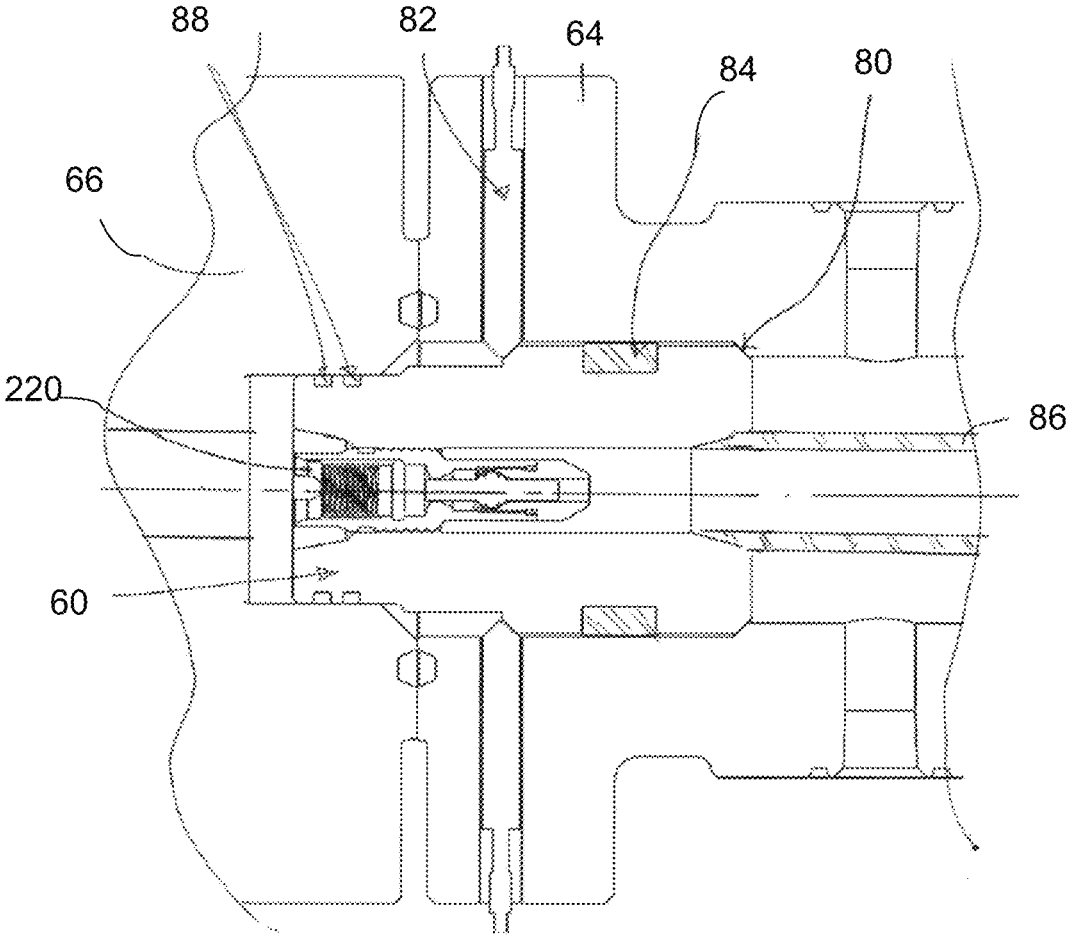
FIG. 6B is a cross sectional view showing a Two-Way Check Valve according to an example embodiment and mode installed in a wellhead tubing hanger.

The exterior surface first segment 41 is configured with an external helical thread 24 to engage a counter-threaded portion of the tubing hanger body, as shown with reference to FIG. 6A and FIG. 6B, for example.

The exterior surface second segment 42 is configured as a circumferential groove to accommodate an essentially toroidal-shaped sealing member. For example, exterior surface second segment 42 is configured as seal seating groove 32 which extends around the circumference of valve body 22. The seal seating groove 32 is configured to accommodate seal 30. The seal 30 may be fabricated from any suitable sealing material, such as an elastomeric material, for example. Other materials may also be utilized, such as Teflon® and Hytrel®, taking into consideration that relative compliant nature of material may affect how the material expands to make up the groove and that for some materials, modifications may be necessary such as an open gland, for example, that would accept the different seal material and usage of another component to close the seal groove up.

Figure 7:
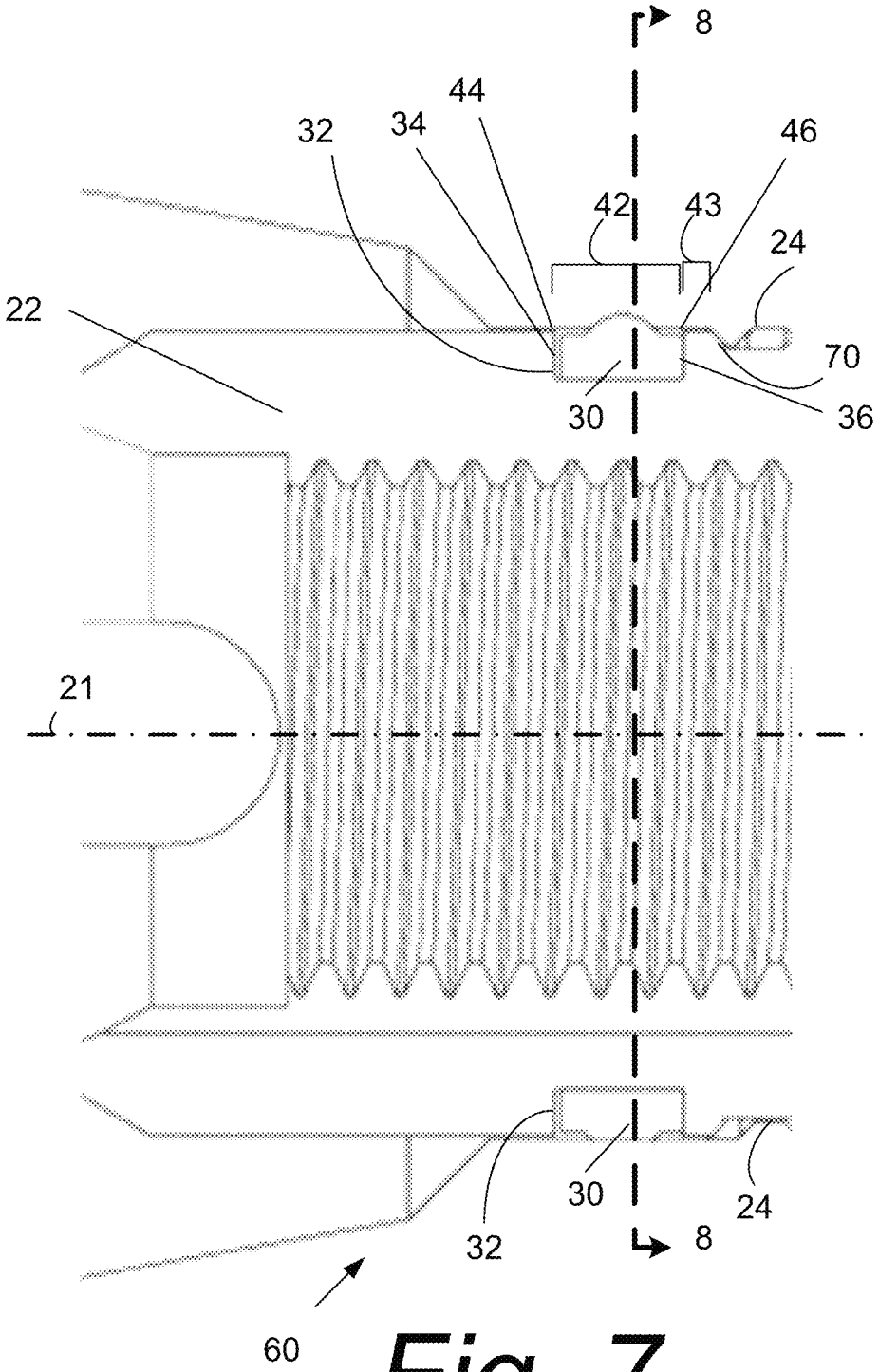
FIG. 7 is a cross sectional enlarged view of a seal structure for either a Back Pressure Valve (BPV) or a Two-Way Check Valve according to an example embodiment and mode.

As shown in more detail in FIG. 7, seal seating groove 32 comprises groove top pressure surface 34 and groove bottom pressure surface 36. The seal seating groove 32 comprises essentially right angle shoulders and at both intersections of the groove 32 with the exterior surface 23. For example, seal seating groove 32 comprises top shoulder 44 at the intersection of groove top pressure surface 34 and exterior surface 23 and bottom shoulder 46 at the intersection of groove bottom pressure surface 36 and exterior surface 23. Both top shoulder 44 and bottom shoulder 46 are essentially ninety degrees. In a radial plane which is perpendicular to the axial direction 21, the groove 32 extends about 0.118 inch. As used herein respecting measurements or dimensions, "essentially", "approximately", or "about" mean plus or minus 5% of the stated numerical value.

As also shown in FIG. 5 and FIG. 7, exterior surface third segment 43 is axially intermediate exterior surface first segment 41 and exterior surface second segment 42. As further shown in FIG. 5 and FIG. 7, the exterior surface third segment 43, in addition to being axially intermediate, is also contiguous with intermediate exterior surface first segment 41 and with exterior surface second segment 42. The exterior surface third segment 43 and is configured to be devoid of any helical thread. Preferably exterior surface third segment 43 assumes the shape of a ring in a plane transverse to valve body axis 21. The exterior surface third segment 43 and may herein be referred to as a positive stop ring. The exterior surface third segment 43, e.g., positive stop ring 43, preferably has an essentially smooth circumferential surface which is parallel to the axial direction for the entire axial extent of the third segment 43. When employed herein to describe shape, "essentially" means that 95% or more of the surface or feature is as described by the property to which "essentially" pertains. Thus, the valves of the technology disclosed herein eliminate the trough 138 of the prior art, increasing the lower pressure surface area which provides full support to the seal.

In an example embodiment and mode, the helical thread has a thread pitch of 0.25 inch, in the axial direction the third segment 43 of the exterior surface extends for about 0.10 inch. In a non-limiting, example embodiment and mode, the third segment 43 of the exterior surface extends in the axial direction 21 for a first axial distance and the groove 32 extends for a second axial distance, and ratio of the first axial distance to the second axial distance is about 3.2 to 1, e.g., 3.2:1.0. In a non-limiting, example embodiment and mode, the ratio of the groove radial distance of groove 32 to the groove axial distance is about 2.7 to 1.0. The example embodiments and modes just mentioned are particularly suitable for use with tubing hangers in which a seal land or surface area may be as small as 0.380 inches. The axial first distance, e.g., axial distance of the third segment 43 of the exterior surface extends, may be greater.

Other constituent elements of valve 20, in an example embodiment and mode in which the valve takes the form of a Back Pressure Valve (BPV), are shown in FIG. 5. For example, on its top end the interior cavity 26 of valve body 22 may be provided with interior threads 50, while towards it middle or bottom end the interior cavity 26 of valve body 22 may contain poppet 28. The poppet 28 may comprise a toroidal poppet seal 52. Interior cavity 26 of valve body 22 may also be configured and/or provided with a seal land 54 for sealing engagement with poppet 28 and/or toroidal poppet seal 52. As is known in the poppet art, the poppet 28 may comprise poppet spring 56 and spring guide pin 58.

Figure 2:
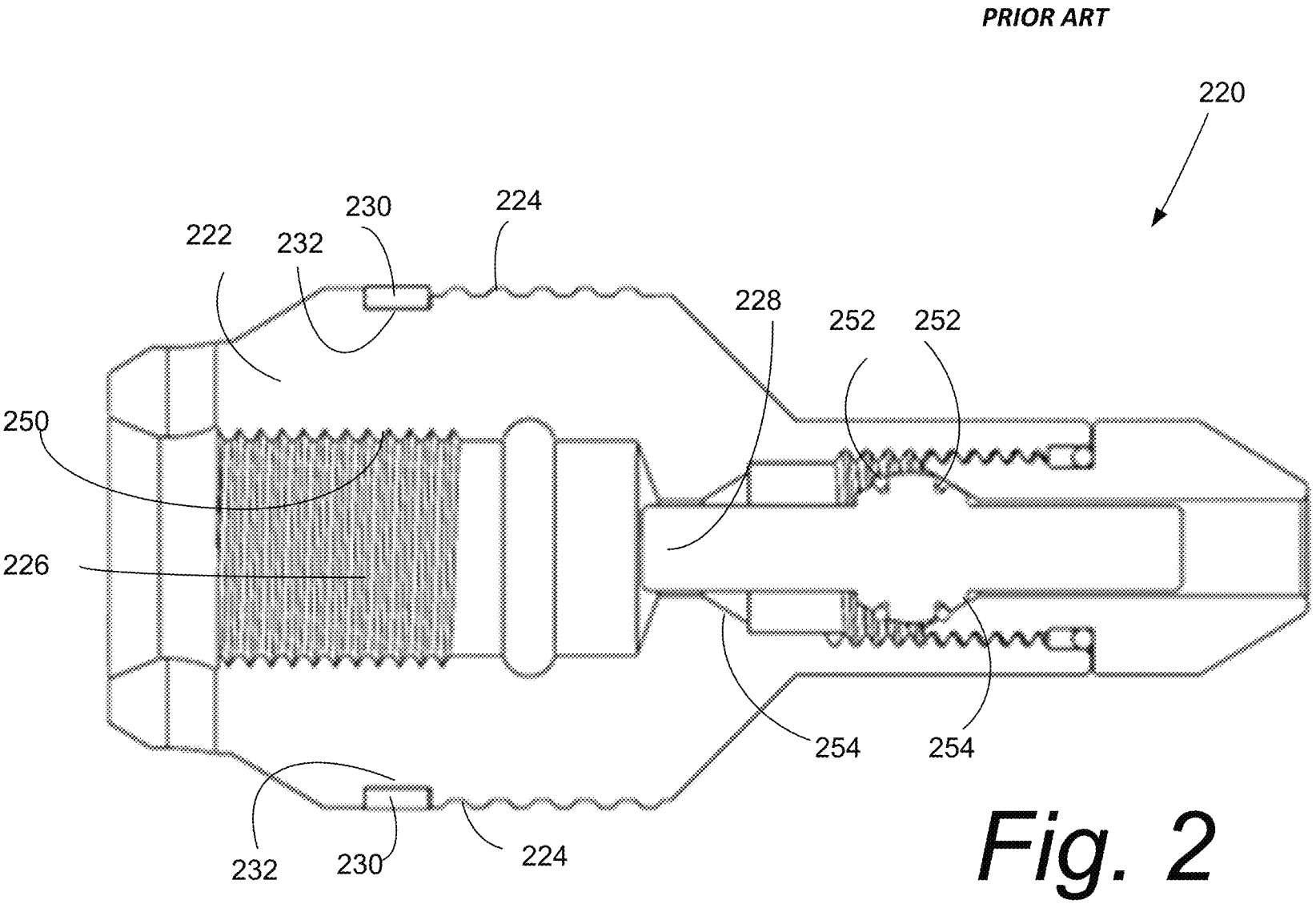
FIG. 2 is a cross sectional view of a prior art Two Way Check Valve (TWCV) for plugging off the tubing in a well from both directions.
Figure 3:
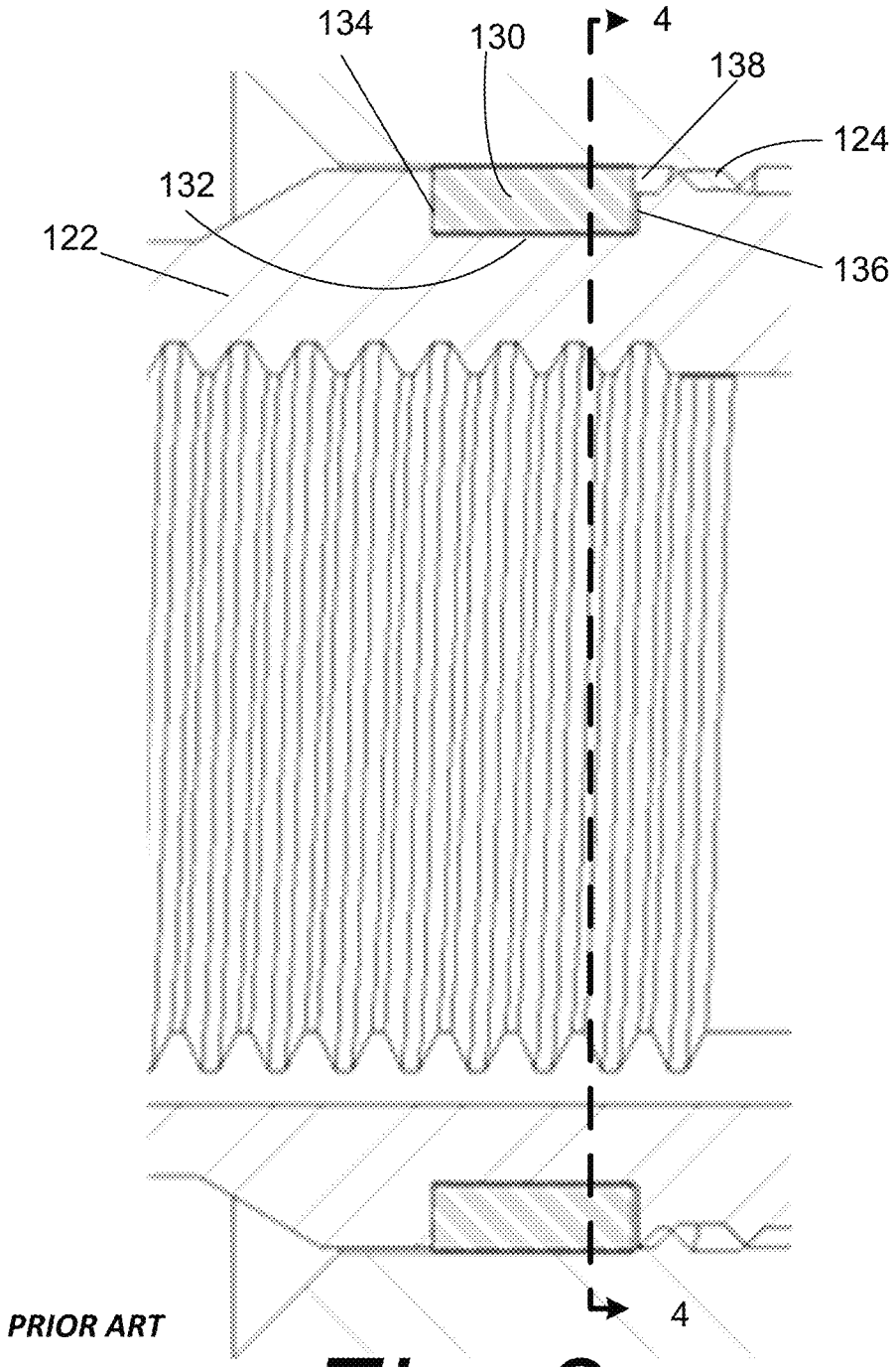
FIG. 3 is a cross sectional enlarged view of prior art seal structure for either a Back Pressure Valve (BPV) of FIG. 1 or a Two-Way Check Valve of FIG. 2.

The valve 20 of FIG. 5 and FIG. 7 has primarily been described as if it were a Back Pressure Valve (BPV). However, as already mentioned above, the valve seal technology of the technology disclosed herein, including but not limited to the exterior surface first segment 41, exterior surface second segment 42, and exterior surface third segment 43, is also applicable to Two-Way Check Valves. To that end, further structure of the Two-Way Check Valve 220 of FIG. 2 is now further mentioned as comprising poppet 228 with poppet seals 252, and poppet seal lands 254.

FIG. 6A and FIG. 6B show how the valves 20 of FIG. 5 and FIG. 7 may be situated in a tubing hanger 60, which in turn is inserted or situated in tubing head 64 of the well. FIG. 6A shows a hanger and valve in a Frac type application; FIG. 6B shows a hanger and valve in a production type application. The tubing hanger 60 does not necessarily seal inside the component bolted on top of it. FIG. 6A further shows tubing head adapter or Christmas tree bottom 66. FIG. 6A also shows the counter-threaded interior surface 68 of the tubing hanger 60, which comprises the threads with which the circumferential exterior threads 24 of exterior surface first segment 41 engage. Although FIG. 6A shows an example situation of a valve in the form of a Back Pressure Valve (BPV) in a tubing hanger 60, it will be appreciated that the situation of a Two-Way Check Valve in a tubing hanger 60 may be similar, depending on application. For example, FIG. 6B shows a Two-Way Check Valve situated in a tubing hanger 60, which again is inserted or situated in tubing head 64 of the well. The situation and installation depends on the particular application.

Normally in a production set up such as shown in FIG. 6B, tubing hanger 60 conveys the production tubing into the well and comprises a load shoulder at its bottom that engages with the hanger load shoulder 80 in the tubing head 64. The tubing hanger seal 84 isolates the area above from pressure migration across the tubing hanger. The extended tubing hanger neck seals 88 serve to seal the Wellhead Tree or Tubing Head adapter when it is landed on the tubing head. This seals the production fluid from exiting and leaking to the environment. Removal of the valve 20 then allows the production fluid or gas to be transmitted to the surface. Thus, in the production application there is a tubing hanging from the tubing hanger which is locked on its landing shoulder by Lockdown Screws. The extended neck of the hanger would then seal off in the bottom of the tubing head adapter or it could seal off on the bottom inner diameter of the wellhead Christmas tree.

By contrast, the Frac type situation, shown by example in FIG. 6A, does not involve a tubing hanging from the tubing hanger but includes a hanger load shoulder 80 that it lands on and is locked in place by lockdown screws 82, similar to those mentioned previously. The hanger load shoulder 80 may also effect a seal at the tubing head adapter corresponding to the load shoulder. FIG. 6B also shows tubing hanger seal 84; production tubing 86; and extended tubing hanger neck seals 88.

The valve 20 of FIG. 5 and FIG. 7, e.g., an improved back pressure valve according to an example embodiment and mode, comprises new features that improve the functionality including improved sealability as well as positive stop ring, e.g., the ring of exterior surface third segment 43, for ease of installation and retrieval for the operator. The features include a modified exterior that includes the positive stop ring 43 and an improved seal carrier groove 32. The seal carrier groove 32 has a closed cross-section having equal pressure surfaces, e.g., groove top pressure surface 34 and groove bottom pressure surface 36. With this improved section, e.g., exterior surface second segment 42 with seal seating groove 32, the seal 30 has more surface area on the lower pressure face 36 than when compared to the lower pressure face 134 of the prior art structure shown in FIG. 4. This ensures the seal remains intact and does not extrude past the metal mating components resulting in a failure to seal at pressures up to 20,000 psi. As mentioned above, the two way check valve comprises the same inventive features as the Back Pressure Valve.

Figure 4:
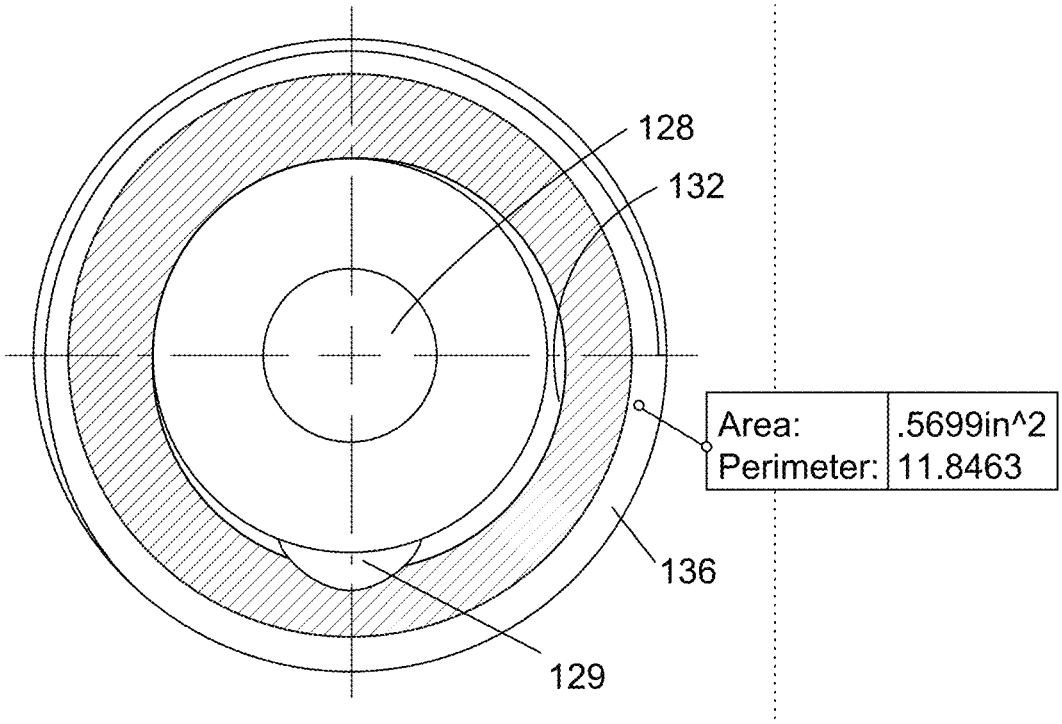
PRIOR ART Fig. 4
FIG. 4 is a sectioned side view of the structure of FIG. 3 taken along line 4-4.
Figure 8:
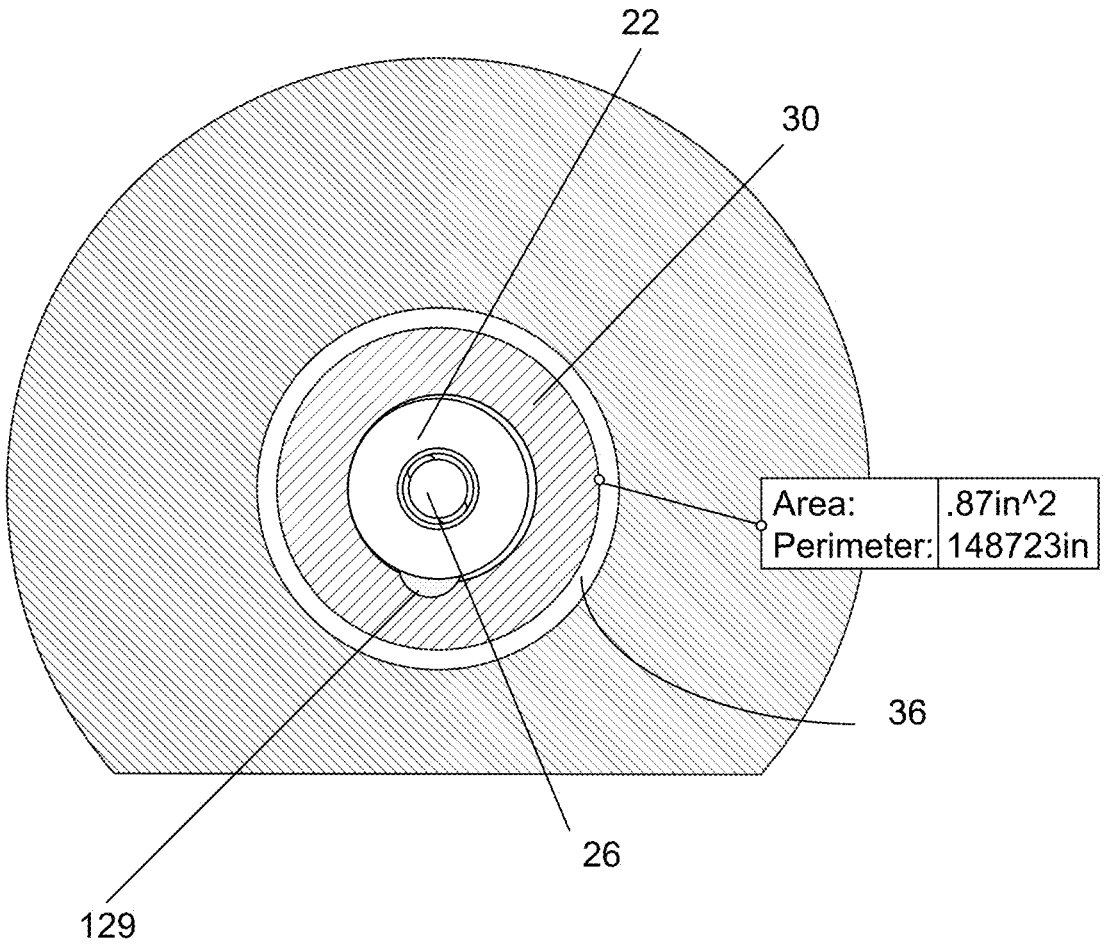
FIG. 8 is a sectioned side view of the structure of FIG. 7 taken along line 8-8.

Comparing FIG. 4 and FIG. 8, it can be seen by this example that the Lower Pressure surface Area 36 of the improved Back Pressure Valve 20 as shown in FIG. 8 is 0.87 $in^2$, whereas the Lower Pressure surface area 136 of the valve of FIG. 4 is 0.5699 $in^2$. This difference equates to approximately 50% lower pressure surface area 36 in the technology disclosed herein, e.g., the structure of FIG. 8, over the prior art of FIG. 4. Therefore, the prior art two way check valve has a smaller lower pressure surface area 136 supporting the seal, thereby increasing the probability for failure. The percentage difference in lower pressure surface areas was calculated for one particular size but will follow the same rules/outcomes for all other sizes in the family.

As shown in FIG. 7, the Positive Stop Ring 43 is machined into the body 22 with a stop ring bottom shoulder 70. The stop ring bottom shoulder 70 is formed at the intersection of exterior surface third segment 43 with exterior first second segment 42. The stop ring bottom shoulder 70 is machined at an angle of 45° to match the 45° flank Angle of the thread machined into the wellhead tubing hanger, e.g., the thread of counter-threaded interior surface 68. Since the positive stop ring feature 43 is machined as a ring that has the same cross-section 360° around the periphery of the body 22 and not machined on a helix angle, the ring 43 will not threadably engage with the thread machined in the tubing hanger 60. Other angles, such as angles greater than or equal to 0° and less than 90°, could be used as the chamfer on the stop ring but may cause damage to the tubing hanger internal thread when the valve 20 is threaded into the tubing hanger 60.

Thus, the technology disclosed herein encompasses an improved well system valve, such as a back pressure valve and/or a two-way check valve, comprising a bore, a valve seat, a poppet biased onto said seat, a seal land, and an external shoulder. The external shoulder comprises a ring machined 360° into the outer surface of the body. The machined ring is not threaded and therefore not threadably engageable with the thread machined into the mating component to which the back pressure valve and two-way check valve are designed to be threaded. The ring structure thus ensures a positive stop and clearly identified stopping position within the well system component for the sealing element.

Figure 9:
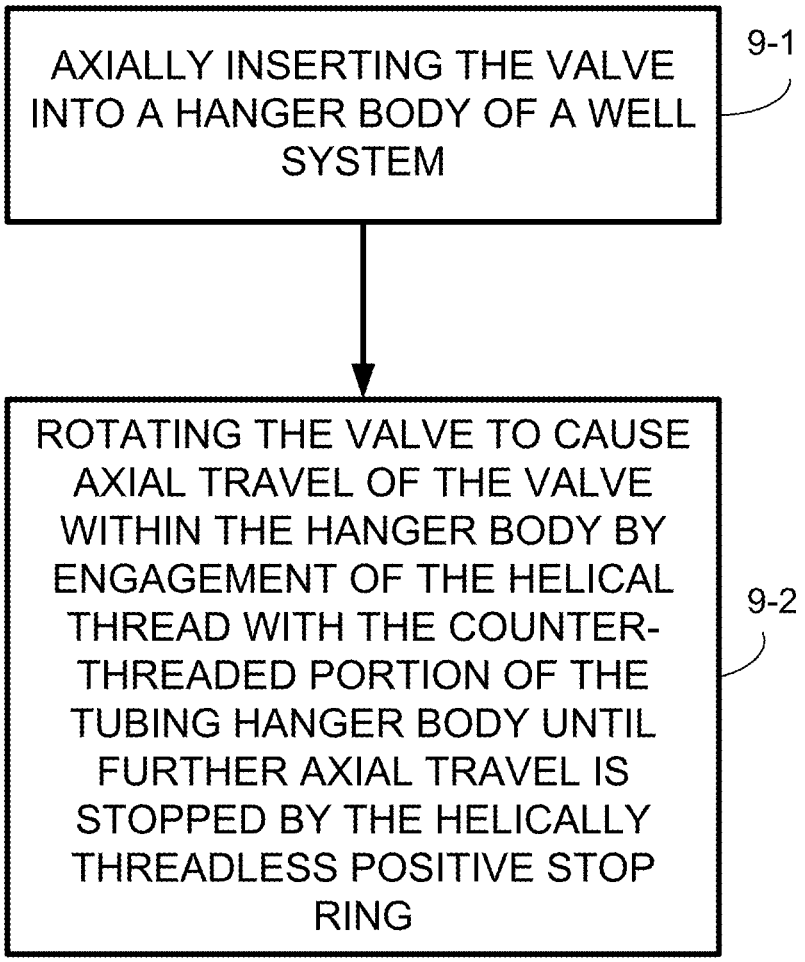
FIG. 9 shows example, basic, representative acts or steps comprising an example embodiment and mode of a method of inserting a valve such as valve 20, into a hanger body of a well system.

FIG. 9 shows example, basic, representative acts or steps comprising an example embodiment and mode of a method of inserting a valve such as valve 20, into a hanger body of a well system. Act 9-1 comprises axially inserting the valve 20, described in example embodiments and modes herein, into a hanger body of a well system. For example, the valve 20 is inserted from the left side of FIG. 6 into the structure of FIG. 6. As example context and optional detail for act 9-1, the valve 20 may be inserted by lowering the valve into the hanger body using a Parmalee wrench until the valve 20 contacts the threads in the tubing hanger.

Act 9-2 comprises rotating the valve 20 to cause axial travel of the valve within the hanger body by engagement of a helical thread of the valve with the counter-threaded portion of the tubing hanger body until further axial travel is stopped by a helically threadless segment of the exterior surface of the valve body, e.g., structurally stopped by the third segment, e.g., by exterior surface third segment 43, also known herein as the positive stop ring 43. As example context and optional detail for act 9-2, when the valve 20 is at the correct depth the Parmalee Wrench is pulled downward and rotated counterclockwise at the same time. Depending on geometry, the valve 20 should come to a stop at approximately 5½ to 6 turns. Unlike the prior art, there is no need or structural opportunity to attempt to apply further torque, since the hard stop afforded by the positive stop ring 43 provides the assurance that the seal is correctly seated in the seal diameter of the hanger. No torque is required to effect a seal, with the advantage that the seal may not be prematurely cut during installation as in the case of the prior art.

Thus, in a radial plane which is perpendicular to the axial direction 21 and which forms the intersection of the exterior surface second segment 42 and the exterior surface third segment 43, the exterior surface third segment 43 is threadless. For example, in such radial plane the thread pattern of the exterior surface first segment 41 does not even partially extend into the bottom shoulder 46 of the seal seating groove 32, which occurs at the intersection of exterior surface second segment 42 and the exterior surface third segment 43. That is, no circumferential surface of the exterior surface third segment 43 in such radial plane includes even a portion of the thread pattern of the exterior surface first segment 41. Preferably the entire circumferential surface of the exterior surface third segment 43 is essentially smooth.

In the prior art method it was necessary for an operator to mark the rod that is used to deliver the valve to its destination, then count the number of turns applied to the valve, and then, when there is resistance, to apply a torque. The applied torque was not measured or applied using a torque tool, but rather the operator relied on operator experience to know when the valve is set in the correct place. By contrast, in accordance with one aspect of the technology disclosed herein as exemplified by the method of FIG. 9, a distinct stop is provided so that no torque need be is applied since the new seal is self-energized when it engages with the sealing surface in the tubing hanger. Thus, the method of FIG. 9 and seal structure of the technology disclosed herein take the uncertainty out of the setting/installation process.

Thus, the technology disclosed herein has many beneficial aspects and advantages.

In one of its example aspects the technology disclosed herein relates to a device for plugging off and controlling an oil and gas type well as one example.

In another of its example aspects the technology disclosed herein relates to a device for plugging off and enabling pressure testing of the connection when new equipment has been installed above the tubing hanger.

In yet another of its example aspects the technology disclosed herein relates to a device that, when run, positively stops in the optimum position in the tubing hanger to ensure effective sealing every time.

In still another of its example aspects the technology disclosed herein relates to the upgrading of the sealing system by providing a proprietary seal design and groove.

In at least some of its example aspects, the technology disclosed herein eliminates the disadvantages by taking the guesswork out of running the valves and the seal seating process making it easier, for those new to running this type of equipment, to install it correctly first time every time. In at least some example embodiments and modes this is achieved by including a 360° ring with a chamfer angle machined into it matching the flank angle of the thread and having a seal and gland that is suitably spaced out from the positive stop ring.

In another of its example aspects the seal groove of example embodiments and modes provides a ring feature that is strategically spaced out from the end of the seal groove and positively stops a valve, such as a Back Pressure Valve (BPV) or a Two-Way Check Valve, from being over threaded into the tubing hanger.

The scope of the technology disclosed herein should be determined by the appended claims and their legal equivalents. Therefore, it will be appreciated that the scope of the technology disclosed herein fully encompasses other embodiments which may become obvious to those skilled in the art, and that the scope of the technology disclosed herein is accordingly to be limited by nothing other than the appended claims, in which reference to an element in the singular is not intended to mean "one and only one" unless explicitly so stated, but rather "one or more." The above-described embodiments could be combined with one another. All structural, chemical, and functional equivalents to the elements of the above-described preferred embodiment that are known to those of ordinary skill in the art are expressly incorporated herein by reference and are intended to be encompassed by the present claims. Moreover, it is not necessary for a device or method to address each and every problem sought to be solved by the technology disclosed herein, for it to be encompassed by the present claims. Furthermore, no element, component, or method step in the present disclosure is intended to be dedicated to the public regardless of whether the element, component, or method step is explicitly recited in the claims.

What is claimed is:

1. A valve configured for insertion in an axial direction into a hanger body of a well system, the valve comprising:

a valve body, the valve body comprising an exterior surface;

a first segment of the exterior surface being configured with a helical thread to engage a counter-threaded portion of the tubing hanger body;

a second segment of the exterior surface being configured as an essentially circumferential groove to accommodate an essentially toroidal sealing member, the groove comprising essentially right angle shoulders at both intersections of the groove with the exterior surface;

a third segment of the exterior surface configured to be a positive stop ring devoid of the helical thread, the third segment being intermediate the first segment and the second segment in the axial direction, the third segment also being contiguous with the first segment and the second segment in the axial direction, the third segment comprising a smooth circumferential surface which is parallel to the axial direction for the entire axial extent of the third segment.

2. The valve of claim 1, wherein the valve is a back pressure valve.

3. The valve of claim 1, wherein the valve is a two way check valve.

4. The valve of claim 1, wherein the third segment of the exterior surface is essentially smooth.

5. The valve of claim 1, wherein in the axial direction the third segment of the exterior surface extends for about 0.1 inch.

6. The valve of claim 5, wherein the helical thread has a thread pitch of 0.25 inch.

7. The valve of claim 1, wherein in the axial direction the third segment of the exterior surface extends for a first axial distance and the groove extends for a second axial distance, and wherein a ratio of the first axial distance to the second axial distance is about 3.2 to 1.

8. The valve of claim 1, wherein in a radial plane which is perpendicular to the axial direction the groove extends about 0.118 inch.

9. The valve of claim 1, wherein in a radial plane which is perpendicular to the axial direction the groove extends for a groove radial distance, and wherein the second segment of the exterior surface extends for a groove axial distance, and wherein a ratio of the groove radial distance to the groove axial distance is about 2.7 to 1.0.

10. The valve of claim 1, further comprising a shoulder formed at an intersection of exterior surface third segment with exterior surface first segment, and wherein the shoulder is machined at an angle to match a thread machined into the hanger body of the well system.

11. The valve of claim 1, wherein the smooth and axially parallel circumferential surface of the third segment is configured to provide an axial stopping position for the valve upon threaded mating of the valve in the hanger body.

12. The valve of claim 1, wherein the third segment is configured to preclude threads of the counter-threaded portion of the tubing hanger body from affecting the essentially toroidal sealing member.

13. The valve of claim 1, wherein toroidal sealing member is deformable.

14. A valve for use in a hanger body of a well system, the valve being configured for insertion into the hanger body in an axial direction, the valve comprising:

a valve body, the valve body comprising an exterior surface;

a first segment of the exterior surface being configured with a helical thread to engage a counter-threaded portion of the tubing hanger body;

a second segment of the exterior surface being configured as an essentially circumferential groove to accommodate an essentially toroidal sealing member;

a third segment of the exterior surface configured to be a positive stop ring essentially smooth and parallel to the axial direction for the entire axial extent of the third segment, the third segment being intermediate the first segment and the second segment in the axial direction and contiguous to the first segment and the second segment in the axial direction.

15. The valve of claim 14, wherein the valve is a back pressure valve.

16. The valve of claim 14, wherein the valve is a two way check valve.

17. The valve of claim 14, wherein in the axial direction the third segment of the exterior surface extends for about 0.10 inches, and wherein the helical thread has a thread pitch of 0.25 inch.

18. The valve of claim 14, wherein the groove comprises essentially right angle shoulders at both intersections of the groove with the exterior surface.

19. The valve of claim 14, wherein the smooth and axially parallel circumferential surface of third segment is configured to provide an axial stopping position for the valve upon threaded mating of the valve in the hanger body.

20. The valve of claim 14, wherein the third segment is configured to preclude threads of the counter-threaded portion of the tubing hanger body from affecting the essentially toroidal sealing member.

21. The valve of claim 14, wherein toroidal sealing member is deformable.

22. A method of inserting a valve into a hanger body of a well system, the method comprising:

axially inserting a valve into a hanger body of a well system, the valve comprising a valve body, the valve body comprising an exterior surface, a first segment of the exterior surface being configured with a helical thread to engage a counter-threaded portion of the tubing hanger body, a second segment of the exterior surface being configured as an essentially circumferential groove to accommodate an essentially toroidal sealing member, the groove comprising essentially right angle shoulders at both intersections of the groove with the exterior surface, a third segment of the exterior surface configured to be a positive stop ring devoid of the helical thread, the third segment being intermediate the first segment and the second segment in the axial direction, the third segment also being contiguous with the first segment and the second segment in the axial direction, the third segment comprising a smooth circumferential surface which is parallel to the axial direction for the entire axial extent of the third segment;

rotating the valve to cause axial travel of the valve within the hanger body by engagement of a helical thread of the valve with a counter-threaded portion of the tubing hanger body until further axial travel is stopped by the third segment of the exterior surface of the valve.

* * * * *